US008818211B2

(12) United States Patent
Yamaoka

(10) Patent No.: US 8,818,211 B2
(45) Date of Patent: Aug. 26, 2014

(54) IMAGE FORMING APPARATUS

(71) Applicant: Hiroyuki Yamaoka, Kasugai (JP)

(72) Inventor: Hiroyuki Yamaoka, Kasugai (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 43 days.

(21) Appl. No.: 13/692,231

(22) Filed: Dec. 3, 2012

(65) Prior Publication Data

US 2013/0142523 A1 Jun. 6, 2013

(30) Foreign Application Priority Data

Dec. 1, 2011 (JP) ..... 2011-263380
Jul. 19, 2012 (JP) ..... 2012-160283

(51) Int. Cl.
*G03G 15/08* (2006.01)

(52) U.S. Cl.
CPC ..... *G03G 15/0863* (2013.01)
USPC ..... 399/12; 399/119

(58) Field of Classification Search
CPC ..... G03G 15/0863; G03G 15/08; G03G 21/1875; G03G 21/1896; G03G 2221/163
USPC ..... 399/12, 119, 252
See application file for complete search history.

(56) References Cited

U.S. PATENT DOCUMENTS 6,295,422 B1 * 9/2001 Curry et al. ..... 399/12
7,596,327 B2 * 9/2009 Kamimura ..... 399/12
8,583,009 B2 * 11/2013 Takagi ..... 399/119
2007/0140743 A1 6/2007 Kamimura
2011/0236062 A1 9/2011 Takagi

FOREIGN PATENT DOCUMENTS

CN 1940759 A 4/2007
CN 102200725 A 9/2011
EP 2 369 422 A1 9/2011
JP 2009-168957 7/2009

OTHER PUBLICATIONS

Chinese Office Action dated Jun. 4, 2014 from related Chinese Application No. 201210505887.0, together with an English language translation.

* cited by examiner

*Primary Examiner* — Gregory H Curran
(74) *Attorney, Agent, or Firm* — Scully, Scott, Murphy & Presser, PC

(57) ABSTRACT

A image forming apparatus includes: a motor; a mounting unit for receiving a cartridge including a detection target moved by a rotational driving force of the motor; a printing unit; a detecting unit for detecting the detection target at a detection position on a movement trajectory of the detection target; and a control unit for controlling the motor and the detecting unit. The control unit performs: a rotation control process of: accelerating the motor; rotating the motor at a constant speed in a time period when accelerating a rotational speed of the motor up to a target speed; detecting the detection target by the detecting unit while the motor rotates at the constant speed; and accelerating again the motor after completing the detection; and a determining process of determining a kind and/or a state of the cartridge on the basis of the detection result of the detecting unit.

15 Claims, 11 Drawing Sheets

IMAGE FORMING APPARATUS

CROSS-REFERENCE TO RELATED APPLICATIONS

This application claims priority from Japanese Patent Application No. 2011-263380 filed on Dec. 1, 2011 and Japanese Patent Application No. 2012-160283 filed on Jul. 19, 2012, the entire subject matters of which are incorporated herein by reference.

TECHNICAL FIELD

The present invention relates to a technology to determine at least one of a kind and state of a cartridge for printing.

BACKGROUND

There have been proposed image forming apparatuses including cartridges, each of which includes: a container that has a light transmitting window; and an agitating member that is positioned in the container and agitates toner. Among them, there have been disclosed a technology to detect an amount of toner remaining in the container on the basis of a result of receiving incident light from the light transmitting window which varies by agitation of the agitating member, and to identify the kind of a cartridge on the basis of at least one of an incident-light receiving interval and the number of times the incident light is received for a predetermined period.

SUMMARY

In the above-described related-art image forming apparatus, in a case of accelerating a motor for rotating the agitating member up to a target speed, when the detection of a remaining amount of toner or the identification of the kind of the cartridge is performed while the motor accelerates, an error may occur in the detection or the identification due to a change in the speed of rotation of the motor according to the acceleration.

On the other hand, when the detection of the remaining amount of toner or the identification of the kind of the cartridge is performed after the speed of rotation of the motor reaches the target speed, the timing when the detection or the identification is performed may become late.

Therefore, illustrative aspects of the invention provide a technology capable of accurately determining a kind of a cartridge or a state of the cartridge such as a remaining amount of toner at an earlier timing.

According to one first illustrative aspect of the invention, there is provided an image forming apparatus comprising: a motor; a mounting unit configured to receive a cartridge mounted therein, the cartridge having a detection target configured to be moved by a rotational driving force of the motor; a printing unit configured to print an image on a sheet using the cartridge; a detecting unit configured to detect the detection target at a detection position on a movement trajectory of the detection target; and a control unit configured to control the motor and the detecting unit. The control unit is configured to perform a rotation control process and a determining process. The rotation control process includes: accelerating a rotational speed of the motor; rotating the motor at a constant speed in a time period when accelerating the rotational speed of the motor up to a target speed; detecting the detection target by the detecting unit in the state where the motor rotates at the constant speed; and accelerating again the rotational speed of the motor after completing the detection. The determining process includes determining at least one of a kind of the cartridge and a state of the cartridge on the basis of the detection result of the detecting unit.

According to another illustrative aspect of the invention, there is provided an image forming apparatus comprising: a motor; a cartridge having a detection target configured to be moved by a driving force of the motor; a detecting unit configured to detect the detection target; and a control unit. The control unit is configured to: control the motor in an accelerating mode in which the control unit accelerates a rotation speed of the motor up to a target speed; and control the motor in a constant mode in which the control unit maintains the rotation speed of the motor at a constant speed. The control unit is configured to switch a mode for controlling the motor from the accelerating mode to the constant mode when the detecting unit detects the detection target. The control unit is configured to determine a state of the cartridge on the basis of the detection result of the detecting unit after the control unit switches the mode for controlling the motor from the accelerating mode to the constant mode.

The illustrative aspects of the invention may be implemented in various modes such as a method of determining the kind or state of a cartridge, a control program for determining the kind or state of a cartridge, and a recording medium having the corresponding program recorded thereon.

According to the above-described image forming apparatus, it is possible to determine the kind and state of the cartridge at an earlier timing as compared to the case of determining the kind or state of the cartridge after the speed of rotation of the motor reaches the target speed. Further, it is possible to determine the kind and state of the cartridge more accurately as compared to the case of determining the kind and state of the cartridge while accelerating the motor.

DETAILED DESCRIPTION

Exemplary Embodiments

Exemplary embodiments of the invention will now be described with reference to FIGS. 1 to 11.

(1) Configuration of Printing Apparatus

Figure 1:
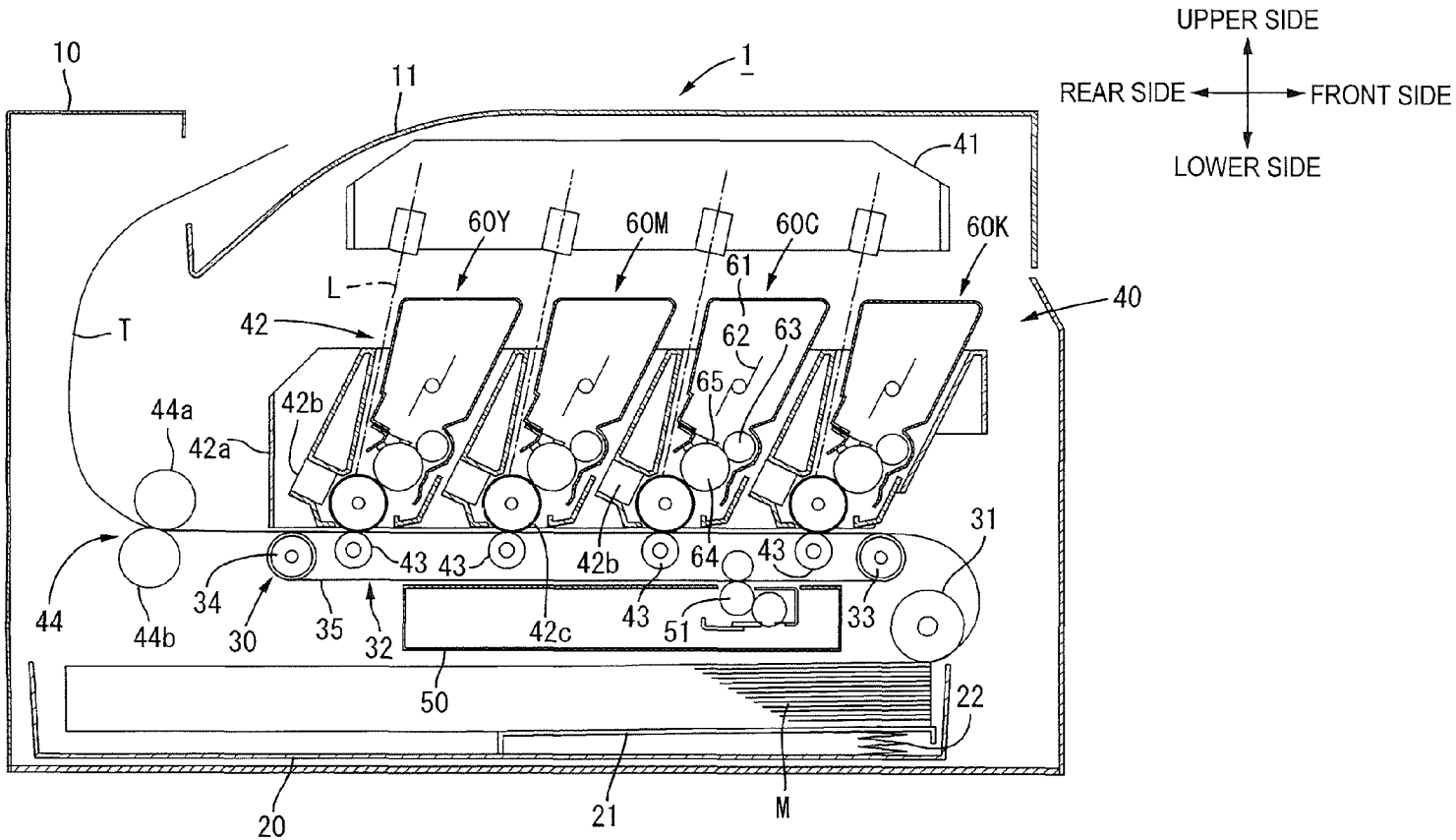
FIG. 1 is a sectional side view schematically illustrating a configuration of a printing apparatus according to one exemplary embodiment.

As shown in FIG. 1, the printing apparatus 1 (one example of an image forming apparatus) includes a main body casing 10, a paper containing unit 20, a conveying unit 30, a printing unit 40, and a cleaning unit 50.

The paper containing unit 20 includes a paper tray 21 for loading printing paper sheets M. The paper tray 21 is pressed upward by a spring 22, such that the uppermost printing paper sheet M on the sheet tray 21 is pressed against a pickup roller 31. The printing paper sheets M are examples of sheets.

The conveying unit 30 includes the pickup roller 31, a belt unit 32, and various rollers (not shown). The belt unit 32 includes a driving roller 33, a driven roller 34, and an endless belt 35 wound around the rollers 33 and 34. The conveying unit 30 conveys the printing paper sheets M contained in the paper containing unit 20, one at a time, along a conveyance path T.

The printing unit 40 includes a scanner unit 41, a processing unit 42, transfer rollers 43, and a film fixing unit 44. The printing unit 40 is configured to form an image on a printing sheet M conveyed by the conveying unit 30 by an electrophotographic system.

The scanner unit 41 includes a laser-beam emitting unit (not shown) configured to emit a laser beam, a polygon mirror (not shown) configured to deflect the laser beam L emitted from the laser-beam emitting unit, an optical system, and so on. The scanner unit 41 is configured to expose a surface of a photosensitive element 42*c* according to an image signal output from a control unit 70 (see FIG. 2). Incidentally, the scanner unit 41 may be configured to expose the photosensitive element 42*c* by LEDs aligned in a plurality of straight lines.

The processing unit 42 includes a processing cartridge 42*a*, a charging unit 42*b*, and the photosensitive element 42*c*.

The processing cartridge 42*a* allows four toner cartridges 60 (60Y, 60M, 60C, and 60K) correspond to four colors of yellow (Y), magenta (M), cyan (C), and black (K) to be mounted and removed. The processing cartridge 42*a* is fixed in the printing apparatus 1 so as to be unable to be removed. The processing cartridge 42*a* is one example of a mounting unit. The configurations of the toner cartridges 60 will be described below.

Incidentally, the processing cartridge 42*a* may be removably mounted to the printing apparatus 1. In this case, a portion of the printing apparatus 1 where the processing cartridge 42*a* is installed is one example of the mounting unit.

The charging unit 42*b* is, for example, a scorotron charger. The charging unit 42*b* is configured to uniformly and positively charge the surface of the photosensitive element 42*c*. After the charging unit 42*b* charges the surface of the photosensitive element 42*c*, the surface of the photosensitive element 42*c* is exposed by a laser beam L emitted from the scanner unit 41 such that an electrostatic latent image is formed on the surface of the photosensitive element 42*c*. The electrostatic latent image formed on the surfaces of the photosensitive element 42*c* is developed by toner supplied from the toner cartridges 60, such that a toner image is carried on the surface of the photosensitive element 42*c*.

The transfer rollers 43 are provided at positions facing the corresponding photosensitive elements 42*c* with the belt 35 interposed therebetween. While a printing paper sheet M conveyed by the belt unit 32 passes transfer positions between the photosensitive elements 42*c* and the transfer rollers 43, the toner image carried on the surface of the photosensitive element 42*c* is transferred onto the printing paper sheet M by a negative transfer bias applied to the transfer rollers 43.

The film fixing unit 44 includes a heat source such as a halogen lamp. The film fixing unit 44 is configured to thermally fix the transferred toner image on the printing paper sheet M to the printing paper sheet M. The configuration of the film fixing unit 44 will be described below.

The printing paper sheet M having the toner image thermally fixed thereon is discharged onto a discharge tray 11. The discharge tray 11 configures the top wall of the main body casing 10.

The cleaning unit 50 is disposed below the belt unit 32. The cleaning unit 50 includes a cleaning roller 51 which comes into contact with the belt 35 to collect remained toner from the belt 35.

(2) Electrical Configuration of Printing Apparatus

Figure 2:
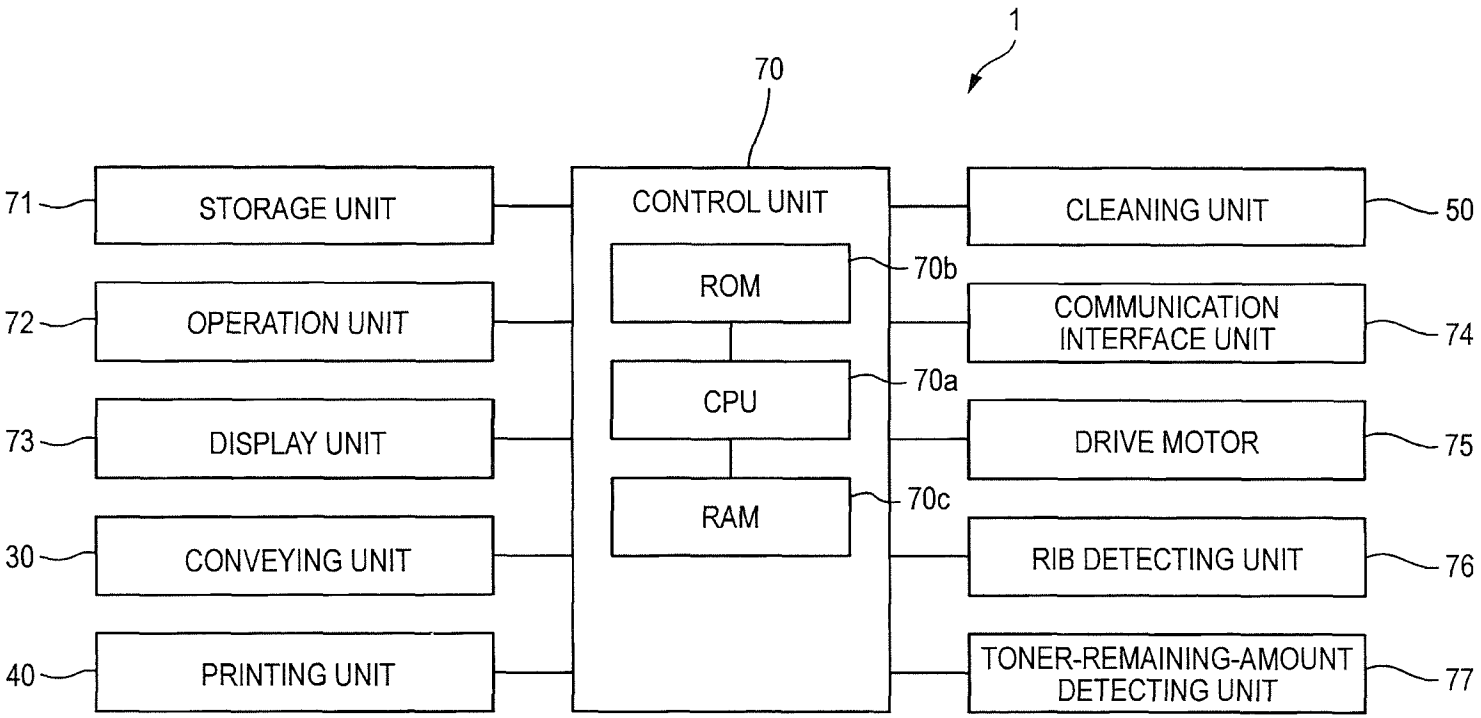
FIG. 2 is a block diagram illustrating an electrical configuration of the printing apparatus.

As shown in FIG. 2, the printing apparatus 1 includes not only the conveying unit 30, the printing unit 40, the cleaning unit 50, and so on described above, but also the control unit 70, a storage unit 71, an operation unit 72, a display unit 73, a communication interface unit 74, a drive motor 75, a rib detecting unit 76, a toner-remaining-amount detecting unit 77, etc.

The control unit 70 includes a CPU 70*a*, a ROM 70*b*, and a RAM 70*c*. The CPU 70*a* controls the operation of the printing apparatus 1 while storing process results in the RAM 70*c*, according to programs read from the ROM 70*b* or the storage unit 71. The ROM 70*b* stores various programs and data for controlling the operation of the printing apparatus 1. The control unit 70 is one example of a control unit, a printing unit, a detecting unit, or a unit for determining whether a cartridge is new or has been used.

The storage unit 71 includes, for example, a hard disk or a flash memory. The storage unit 71 stores various programs for controlling the operation of the printing apparatus 1.

The operation unit 72 includes a plurality of buttons. The operation unit 72 is configured to receive various kinds of input operation such as a print start instruction input by a user.

The display unit 73 includes a liquid crystal display, lamps, and so on. The display unit 73 is configured to display various setting screens, operation states, and so on.

The communication interface unit 74 is connected to a terminal device through a communication network. The communication interface unit 74 is configured to receive print jobs from the terminal device.

The drive motor 75 is, for example, a stepping motor. The drive motor 75 is a driving source for rotating rotary mechanisms of the printing apparatus 1 or rotary mechanisms of each toner cartridge 60. The rotary mechanisms of the printing apparatus 1 include the conveying unit 30, the printing unit 40, the cleaning unit 50, and so on. On the other hand, the rotary mechanisms of each toner cartridge 60 include an agitator 62, a feeding roller 63, a developing roller 64, a sector gear 67, and so on.

These rotary mechanisms may be driven by one drive motor 75, or may be driven by a plurality of drive motors 75. In the present exemplary embodiment, all of these rotary mechanisms are driven by one drive motor 75. The drive motor 75 is one example of a motor. The control unit 70 is configured to control the drive motor 75 in an accelerating mode in which the control unit 70 accelerates a rotation speed of the drive motor 75 up to a target speed, and to control the drive motor 75 in a constant mode in which the control unit 70 maintains the rotation speed of the drive motor 75 at a constant speed.

The rib detecting unit 76 and the toner-remaining-amount detecting unit 77 will be described below.

(3) Configuration of Film Fixing Unit

Figure 3:
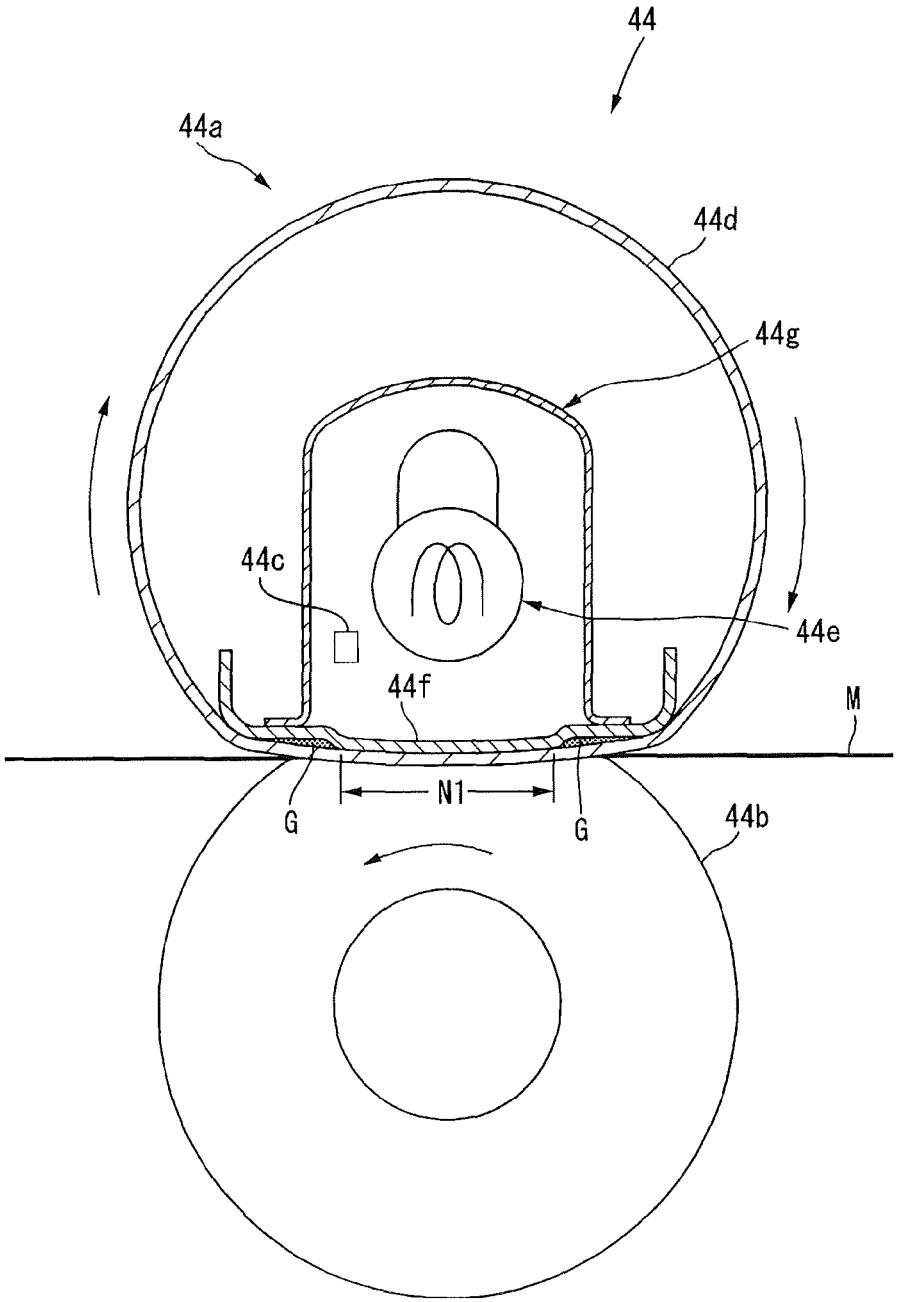
FIG. 3 is a cross-sectional view illustrating a film fixing unit.

As shown in FIG. 3, the film fixing unit 44 includes a heating member 44*a* configured to heat the printing paper sheet M, a pressing roller 44*b* that is disposed to face the heating member 44*a* and forms a nip portion N1 for sandwiching a paper sheet in cooperation with the heating member 44*a*, and a temperature measuring sensor 44*c*.

The heating member 44*a* includes a cylindrical fixing film 44*d*, a heater 44*e* for raising the temperature of the fixing film 44*d*, a nip plate 44*f*, and a reflective plate 44*g*.

The heater 44*e* is, for example, a halogen lamp. The heater 44*e* is disposed inside the cylindrical fixing film 44*d* with predetermined gaps from the inner surfaces of the fixing film 44*d* and the nip plate 44*f*. The heater 44*e* is configured to generate heat to raise the temperature of the fixing film 44*d*. The heater 44*e* is one example of a heat source.

The fixing film 44*d* is a film having heat resistance and flexibility. The rotation of both end portions of the fixing film 44*d* in the width direction is guided by guide members (not shown). The fixing film 44*d* rotates by a rotational driving force of the drive motor 75 to thermally fix toner to a printing paper sheet M. The fixing film 44*d* is one example of a rotary body, and the film fixing unit 44 is one example of a rotary mechanism.

The nip plate 44*f* is a plate-like member for receiving the pressing force of the pressing roller 44*b* and transferring radiant heat from the heater 44*e* to toner on a printing paper sheet M through the fixing film 44*d*. In other words, the pressing roller 44*b* is configured to press the nip plate 44*f*. The nip plate 44*f* is disposed to be slidably in contact with the inner surface of the cylindrical fixing film 44*d*.

Between the nip plate 44*f* and the fixing film 44*d*, a lubricant G is held to smoothly rotate the fixing film 44*d*. As the lubricant G, for example, heat-resistant fluorine grease can be used.

The reflective plate 44*g* is a member for reflecting the radiant heat from the heater 44*e* toward the nip plate 44*f*.

The temperature measuring sensor 44*c* is a sensor for measuring a temperature correlating with the temperature of the lubricant G and outputting a temperature signal according to the measured temperature to the control unit 70. For example, the temperature correlating with the temperature of the lubricant G may be the temperature of the interior space of the reflective plate 44*g*, the temperature of the heater 44*e*, the temperature of the nip plate 44*f*, or the temperature of the lubricant G. The temperature measuring sensor 44*c* is one example of a temperature measuring unit, and the temperature correlating with the temperature of the lubricant G is one example of the temperature of the film fixing unit 44.

(4) Configuration of Toner Cartridge

As shown in FIG. 1, each toner cartridge 60 includes a toner container 61, an agitator 62, a feeding roller 63, a developing roller 64, a layer-thickness regulating blade 65, light transmitting windows 66 (see FIG. 4) provided at two facing walls of the toner container 61, a sector gear 67 (see FIG. 4) provided on an outer wall of the toner cartridge 60, and so on. The toner cartridge 60 is one example of a cartridge.

The toner container 61 contains positively charged non-magnetic toner. The agitator 62 rotates to agitate the toner in the toner container 61. The agitator 62 is one example of an agitating member. Further, the toner and the agitator 62 are examples of detection targets (e.g., objects to be detected).

The toner agitated by the agitator 62 is fed to the developing roller 64 by rotation of the feeding roller 63. According to the rotation of the developing roller 64, the toner fed to the developing roller 64 comes between the layer-thickness regulating blade 65 and the developing roller 64, so as to be carried as a thin layer having a constant thickness at the outer periphery of the developing roller 64. The toner carried by the developing roller 64 is fed to an electrostatic latent image formed on the surface of the photosensitive element 42*c*, whereby a toner image is carried on the surface of the photosensitive element 42*c*.

Figure 4:
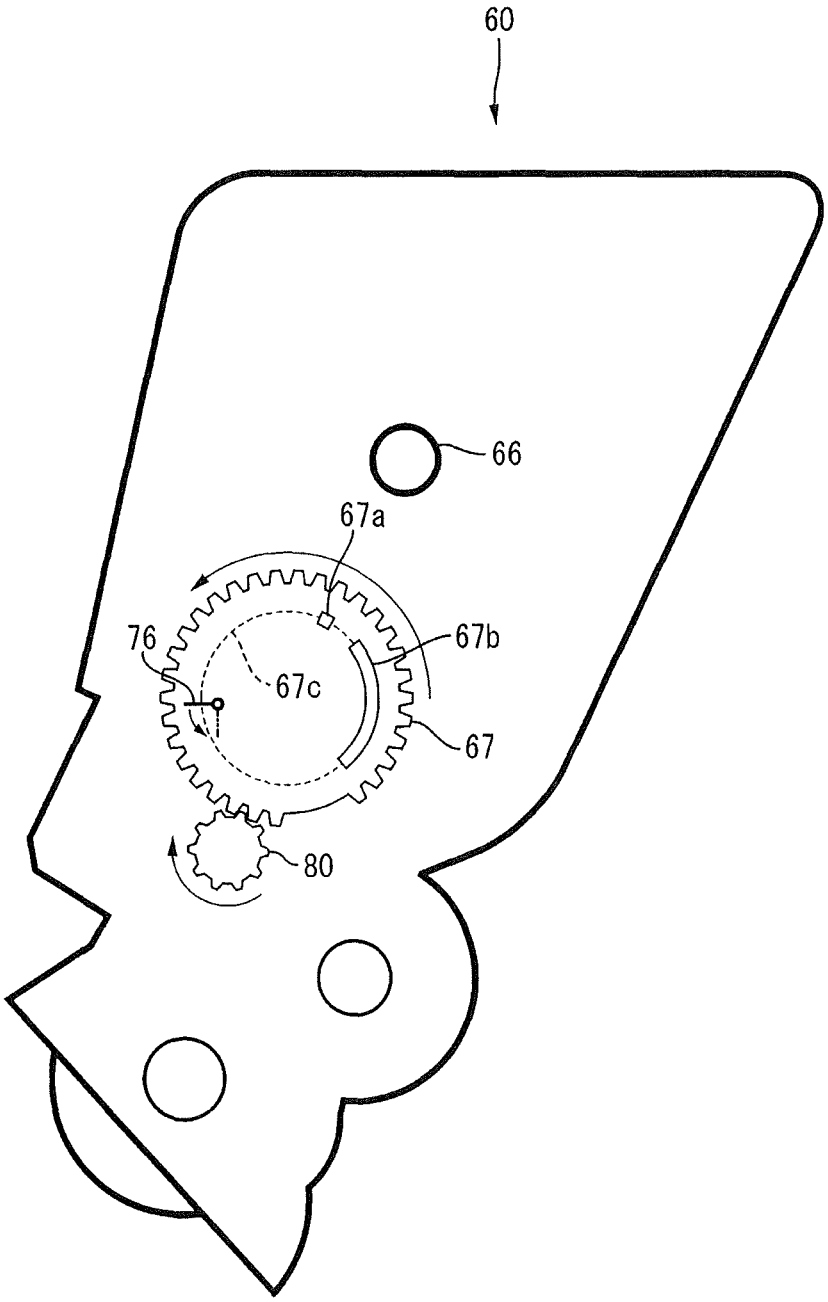
FIG. 4 is a schematic view illustrating a side of a new toner cartridge.

FIG. 4 is a schematic view illustrating a side of a new toner cartridge 60. In a case where the toner cartridge 60 is new, the sector gear 67 is engaged with a gear 80 provided on the printing apparatus (1) side, such that the rotational driving force of the drive motor 75 is transmitted to the sector gear 67. Therefore, the sector gear 67 rotates.

The sector gear 67 includes a first rib 67*a* and a second rib 67*b*. As will be described below in detail, the first rib 67*a* has a role to detect whether the toner cartridge 60 is new, and has a role of notifying the control unit 70 that the second rib 67*b* will pass a detection position soon.

The second rib 67*b* is for determining the kind of the toner cartridge 60. The length of the second rib 67*b* in a movement direction depends on the kind of the toner cartridge 60, and thus it is possible to determine the kind of the toner cartridge 60 according to the length of time when the second rib 67*b* passes the detection position. The first rib 67*a* and the second rib 67*b* are examples of the detection targets (e.g., objects to be detected). Further, the first rib 67*a* and the second rib 67*b* are examples of a first detection target and a second detection target, respectively.

Figure 5:
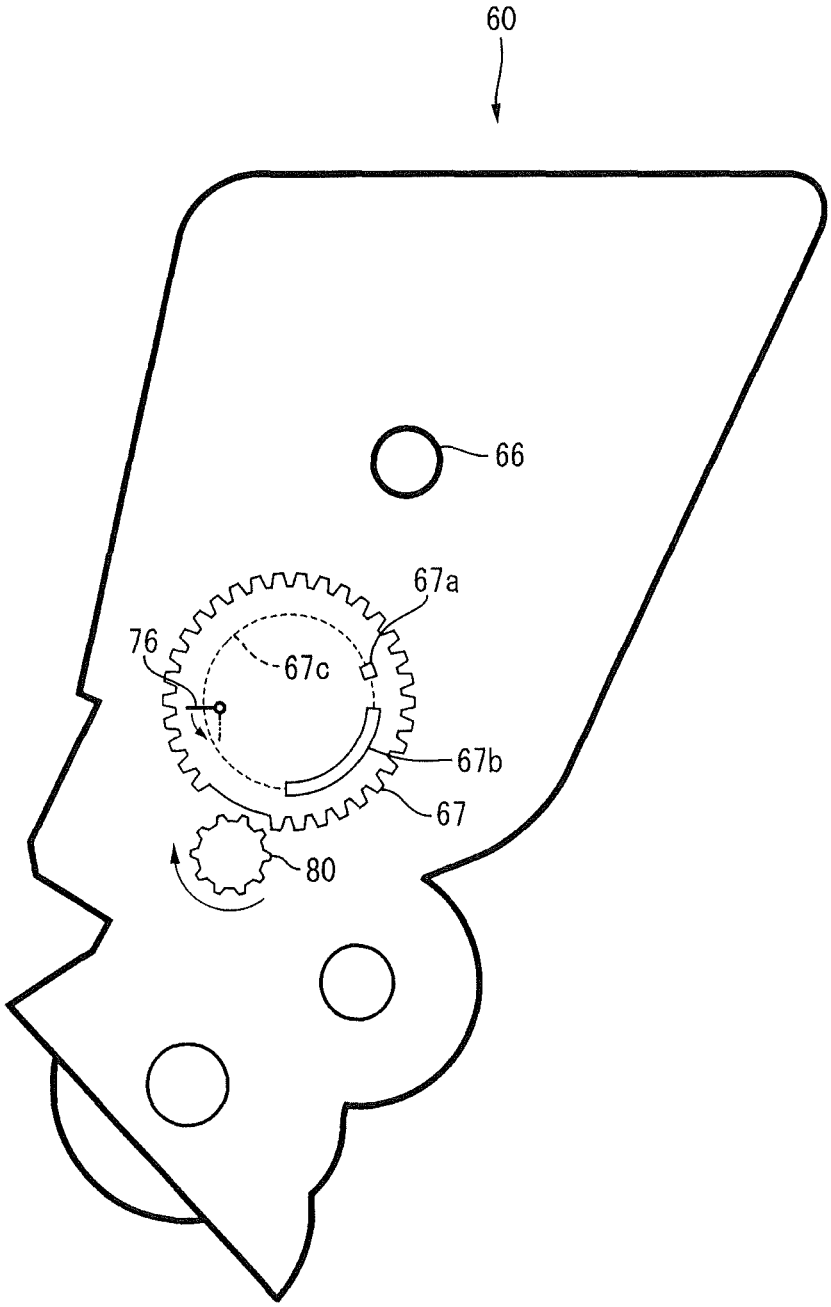
FIG. 5 is a schematic view illustrating a side of a toner cartridge having been used.

FIG. 5 is a schematic view illustrating a side of a toner cartridge 60 having been used. When the sector gear 67 rotates, since the sector gear 67 is disengaged from the gear 80, the sector gear 67 does not rotate any more. Therefore, in a case where the toner cartridge 60 is a toner cartridge having been used, the first rib 67*a* and the second rib 67*b* do not move on a movement trajectory shown by a broken line.

(5) Configuration of Rib Detecting Unit

As shown in FIG. 4, on the printing apparatus (1) side, a rib detecting unit 76 for detecting the first rib 67*a* and the second rib 67*b* is provided at the detection position on a movement trajectory 67*c* of the first rib 67*a* and the second rib 67*b*. The rib detecting unit 76 is a mechanical switch. When the first rib 67*a* or the second rib 67*b* is at the detection position, the rib detecting unit 76 is pushed by the corresponding rib, so as to become an ON state. On the other hand, when any ribs are not at the detection position, the rib detecting unit 76 is not pushed by any ribs, so as to become an OFF state.

When the rib detecting unit 76 is in the ON state, the rib detecting unit 76 outputs an ON signal as a rib detection signal to the control unit 70. When the rib detecting unit 76 is in the OFF state, the rib detecting unit 76 outputs an OFF signal to the control unit 70. The rib detecting unit 76 is one example of a detecting unit.

Figure 6:
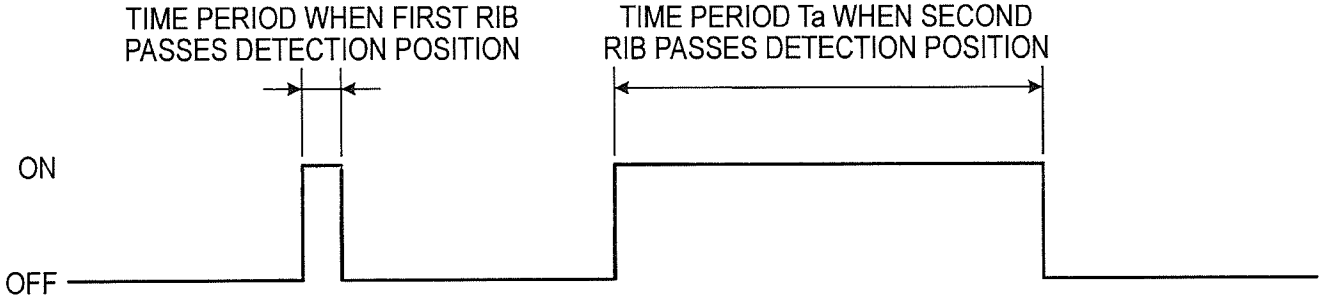
FIG. 6 is a schematic view illustrating a rib detection signal.

FIG. 6 is a schematic view illustrating a rib detection signal which is output from the rib detecting unit 76 in the case where the toner cartridge 60 is new. The rib detection signal is in an OFF state until the first rib 67*a* reaches the detection position. After the first rib 67*a* reaches the detection position, the detection signal is in an ON state until the first rib 67*a* completely passes the detection position. Next, the rib detection signal is in the OFF state again until the second rib 67*b* reaches the detection position. After the second rib 67*b* reaches the detection position, the rib detection signal is in the ON state again until the second rib 67*b* completely passes the detection position. Then, if the second rib 67*b* passes the detection position, the detection signal becomes the OFF state.

Instead of the first rib 67*a* and the second rib 67*b*, for example, seals having optical reflectance different from that of the surface of the sector gear 67 may be attached, and be optically detected by the rib detecting unit 76. Alternatively, the first rib 67*a* and the second rib 67*b* may be optically detected.

(6) Detection on Whether Toner Cartridge is New

As described above, when the toner cartridge 60 is new, the first rib 67*a* and the second rib 67*b* moves on the movement trajectory 67*c*. On the other hand, when the toner cartridge 60 is the toner cartridge having been used, the first rib 67*a* and the second rib 67*b* do not move on the movement trajectory 67*c*. In other words, when the toner cartridge 60 is new, the rib detection signal to be output from the rib detecting unit 76 changes from the OFF state to the ON state, and when the toner cartridge 60 is the toner cartridge having been used, the rib detection signal is maintained in the OFF state. In the case where the rib detection signal changes from the OFF state to the ON state, the control unit 70 determines that the toner cartridge 60 is new. When the detection signal is maintained in the OFF signal, the control unit 70 determines that the toner cartridge 60 is the toner cartridge having been used.

(7) Determination of Kind of Toner Cartridge

A time period when the second rib 67*b* of each kind of toner cartridge 60 passes the detection position is measured in advance, and the storage unit 71 stores the measured time period as a reference time period in association with the corresponding kind of toner cartridge 60.

The control unit 70 measures a time period from when the rib detection signal corresponding to the second rib 67*b* becomes the ON state to when the rib detection signal becomes the OFF state, that is, a time period (e.g., a time period Ta shown in FIG. 6) when the second rib 67*b* passes the detection position. The time period when the second rib 67*b* passes the detection position is one example of a detection result of the detecting unit. In this case, the control unit 70 configures a portion of the detecting unit.

Next, the control unit 70 compares the measured time period with each reference time period stored in the storage unit 71, and determines that a kind associated with a reference time period closest to the measured time period is the kind of currently installed toner cartridge 60.

As will be described below in detail, in the present exemplary embodiment, the rotational speed of the drive motor 75 when the time period when the second rib 67*b* passes the detection position is measured may not be fixed to one value. In the case where the rotational speed of the drive motor 75 is not fixed to one value, for one kind of toner cartridges 60, the time period when the second rib 67*b* passes the detection position depends on the rotational speed of the drive motor 75.

For this reason, the storage unit 71 stores a reference time period for each kind of toner cartridge 60, and for each achievable rotational speed of the drive motor 75 in each kind of toner cartridge 60. Instead of storing a reference time period for each rotational speed, a reference time period may be stored for one reference speed, and a reference time period according to the rotational speed of the drive motor 75 may be calculated from a ratio between the reference speed and the corresponding rotational speed. The reference time period is one example of a reference value.

Here, as described above, the sector gear 67 rotates only once when the toner cartridge 60 is new. Therefore, an opportunity to determine the kind of the toner cartridge 60 is only when the toner cartridge 60 is new.

(8) Configuration of Toner-remaining-amount Detecting Unit

Figure 7:
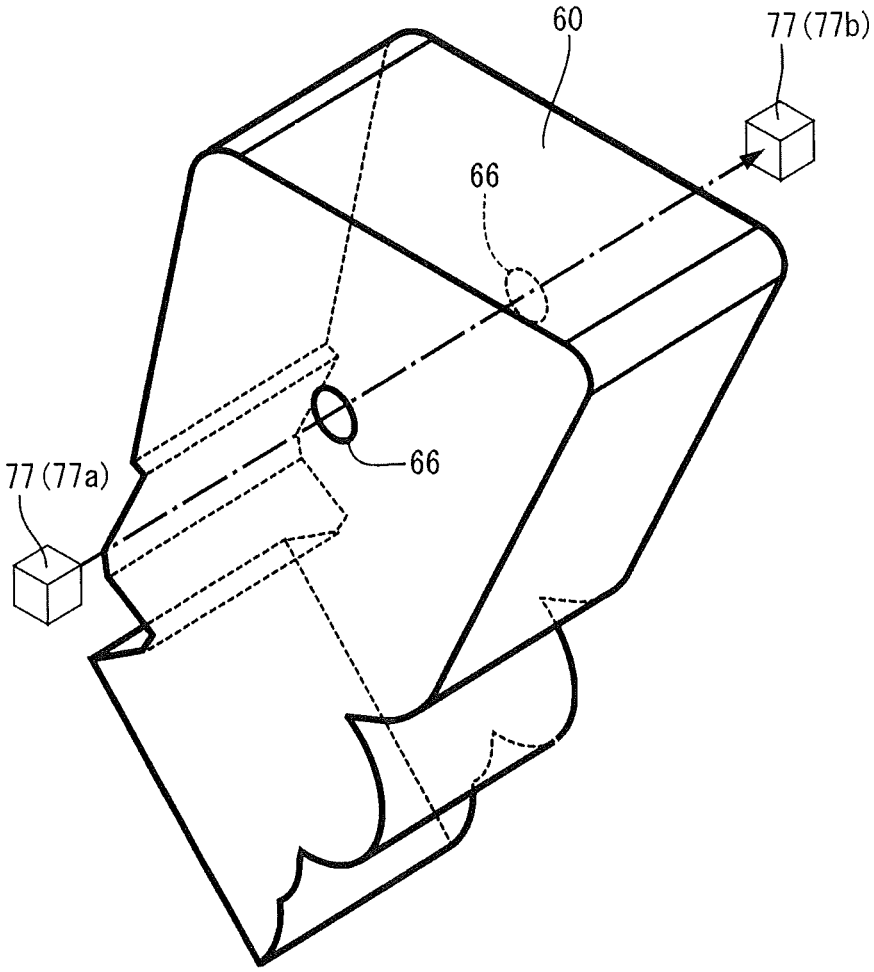
FIG. 7 is a schematic view illustrating a configuration of a toner-remaining-amount detecting unit.

FIG. 7 is a schematic view illustrating the configuration of the toner-remaining-amount detecting unit 77 for determining the remaining amount of toner. The toner-remaining-amount detecting unit 77 includes a light emitting unit 77*a* configured to emit light from the outside of the toner cartridge 60 toward one light transmitting window 66, and a light receiving unit 77*b* configured to receive the light having passed through the two light transmitting windows 66 and output a toner detection signal according to the brightness of the received light to the control unit 70.

(9) Determination of Remaining Amount of Toner

Figure 8:
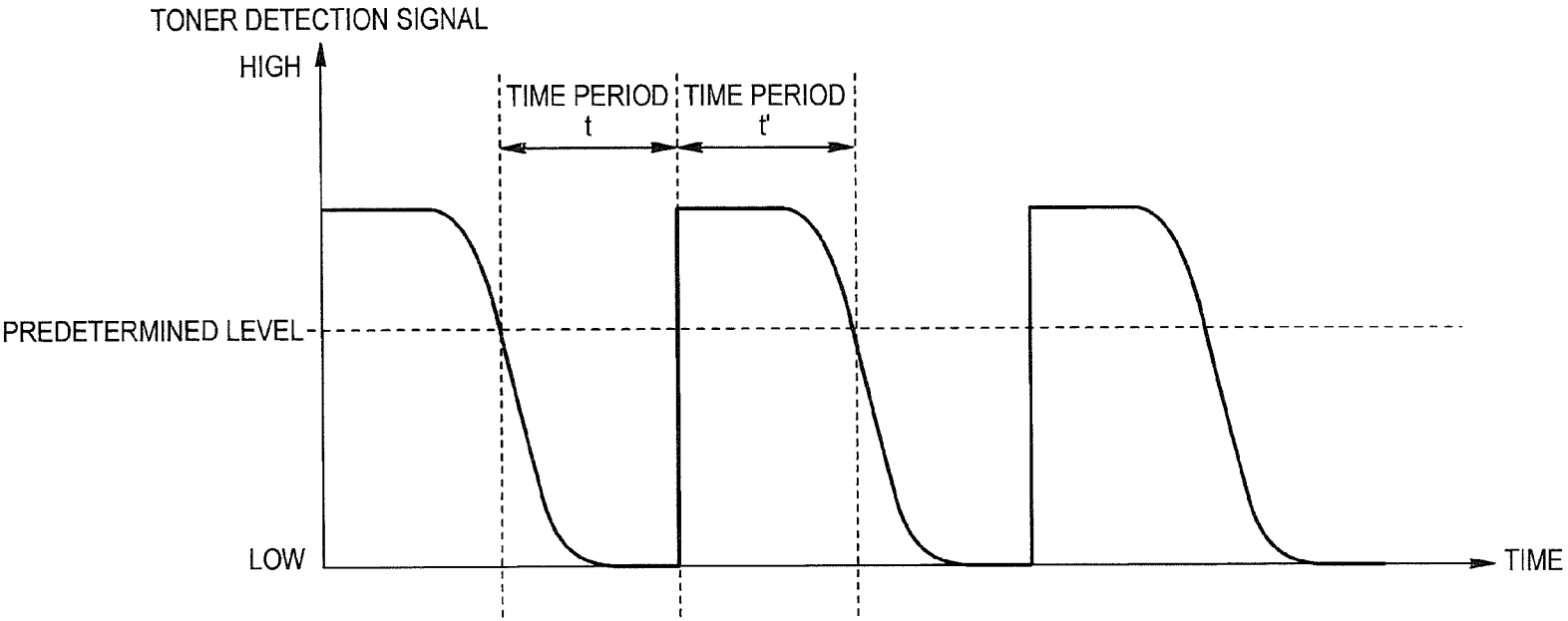
FIG. 8 is a schematic view illustrating a waveform of a general toner detection signal.

FIG. 8 is a view illustrating the waveform of a general toner detection signal in the toner-remaining-amount detecting unit 77. In FIG. 8, the vertical axis represents the level of the toner detection signal. When the agitator 62 rotates so as to scrape the toner, a light path from the light emitting unit 77*a* to the light receiving unit 77*b* is gradually shielded from light by the toner. In other words, the level of the toner detection signal gradually decreases. Then, when the agitator 62 passes the light path, the scraped toner also passes the light path. Therefore, the degree of light shielding by the toner decreases, and thus the level of the toner detection signal increases.

The control unit 70 detects a time period t from when the level of the toner detection signal becomes a predetermined level or less to when the toner detection signal recovers the predetermined level or more, and determines the remaining amount of toner from the time period t. For example, if the relation between the time period t and the remaining amount of toner is approximated by a linear function expressed by the following Equation 1, the control unit 70 calculates the remaining amount of toner from that linear function.

$$(\text{Remaining Amount of Toner})=\alpha\times(\text{Time Period } t)+\beta \qquad \text{Equation 1}$$

However, for a remaining amount of toner, the time period t depends on the rotational speed of the drive motor 75. For this reason, in the storage unit 71, a slope $\alpha$ is stored for each achievable rotational speed of the drive motor 75. Instead of storing a slope $\alpha$ for each rotational speed, a slope $\alpha$ may be stored for one reference speed, and a slope $\alpha$ according to the rotational speed of the drive motor 75 may be calculated from a ratio between the reference speed and the corresponding rotational speed.

Incidentally, a time period t' from when the level of the toner detection signal becomes a predetermined level or more to when the level of the toner detection signal becomes the predetermined level or less may be detected, and the remaining amount of toner may be determined form the time period t'. Alternatively, the remaining amount of toner may be determined from a ratio between the time period t and the time period t'.

The slope $\alpha$ may depend on the kind of the toner cartridge 60.

(10) Control on Rotation of Drive Motor

The drive motor 75 is not only a driving source of the rotary mechanism such as the sector gear 67 included in each toner cartridge 60, but also a driving source of the rotary mechanism of the printing apparatus 1. For this reason, a load to be applied on the drive motor 75 depends on the state of the rotary mechanism of the printing apparatus 1. For example, when the temperature of the lubricant G of the film fixing unit 44 is low, the viscosity of the lubricant G becomes high and thus the load to be applied on the drive motor 75 becomes high. On the other hand, when the temperature of the lubricant G is high, the viscosity of the lubricant G becomes low, and thus the load to be applied on the drive motor 75 becomes low.

In a case where the load to be applied on the drive motor 75 varies in that way, if the rotation of the drive motor 75 is controlled in the same way regardless of the load to be applied on the drive motor 75, a high load to be applied to the drive motor 75 may cause trouble in the determination of the kind of the toner cartridge 60 or the determination of the remaining amount of toner.

Therefore, the control unit 70 controls the rotation of the drive motor 75 in different ways between a case of a high load state in which the load on the drive motor 75 is a predetermined load or more and a case of a low load state in which the load on the drive motor 75 is less than the predetermined load. This will be hereinafter described in detail.

(10-1) Control on Rotation of Drive Motor in Case of Low Load State

Figure 9:
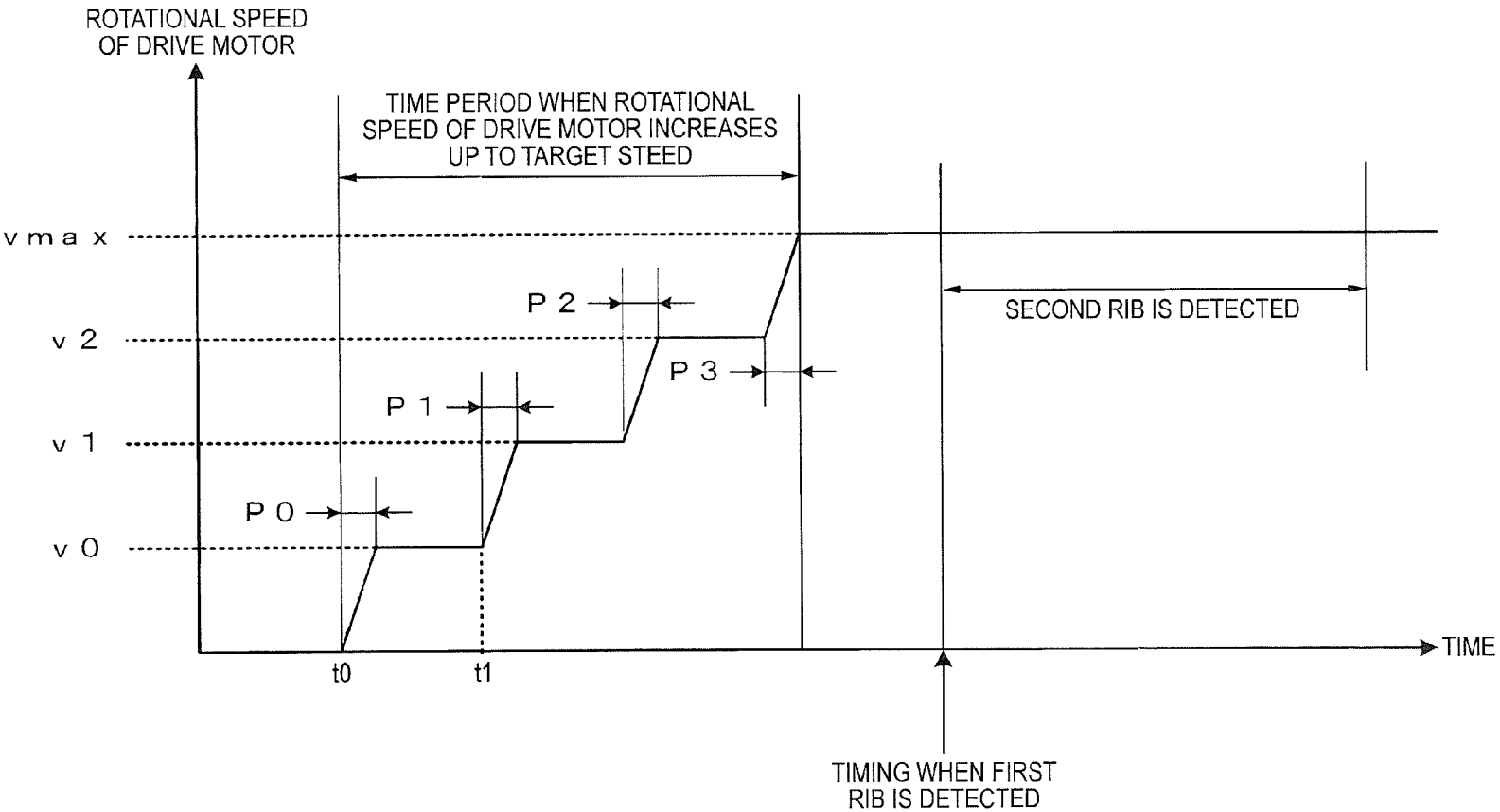
FIG. 9 is a graph illustrating control on a rotation of a drive motor in a case of a low load state.

FIG. 9 is a graph for explaining control on the rotation of the drive motor 75 in the case of the low load state. Here, a case of increasing the rotational speed up to a target speed in a stepwise manner will be described as an example. Increasing the rotational speed in the stepwise manner is adopted in view of a case where continuous acceleration may not be suitable for some rotary mechanisms.

In the case of the low load state in which the load on the drive motor 75 is low, it is possible to increase an acceleration for accelerating (increasing) the rotational speed of the drive motor 75. Therefore, the control unit 70 increases the rotational speed of the drive motor 75 with a first acceleration larger than an acceleration (e.g., second acceleration) in the case of the high load state in which the load on the drive motor 75 is high.

In FIG. 9, vmax is an example of the target speed. In the example shown in FIG. 9, a case where acceleration starts at a time point t0 is shown, and the control unit 70 increases the rotational speed of the drive motor 75 up to v0 with the first acceleration and suspends the acceleration. Then, the control unit 70 maintains the rotational speed of the drive motor 75 at v0 until a time point t1. If the time point t1 is reached, the control unit 70 increases the rotational speed of the drive motor 75 up to v1 with the first acceleration. Next, the control unit 70 performs acceleration up to v2 and acceleration up to vmax with the first acceleration. When the rotational speed reaches vmax, the control unit 70 finishes the acceleration.

In this exemplary embodiment, it is assumed that, in the case of increasing the rotational speed of the drive motor 75 with the first acceleration, the rotational speed of the drive motor 75 reaches the target speed before the second rib 67*b* reaches the detection position. Therefore, in the case of the low load state, after the rotational speed of the drive motor 75 reaches the target speed, it is possible to measure the time period when the second rib 67*b* passes the detection position.

(10-2) Control on Rotation of Drive Motor in Case of High Load State

Figure 10:
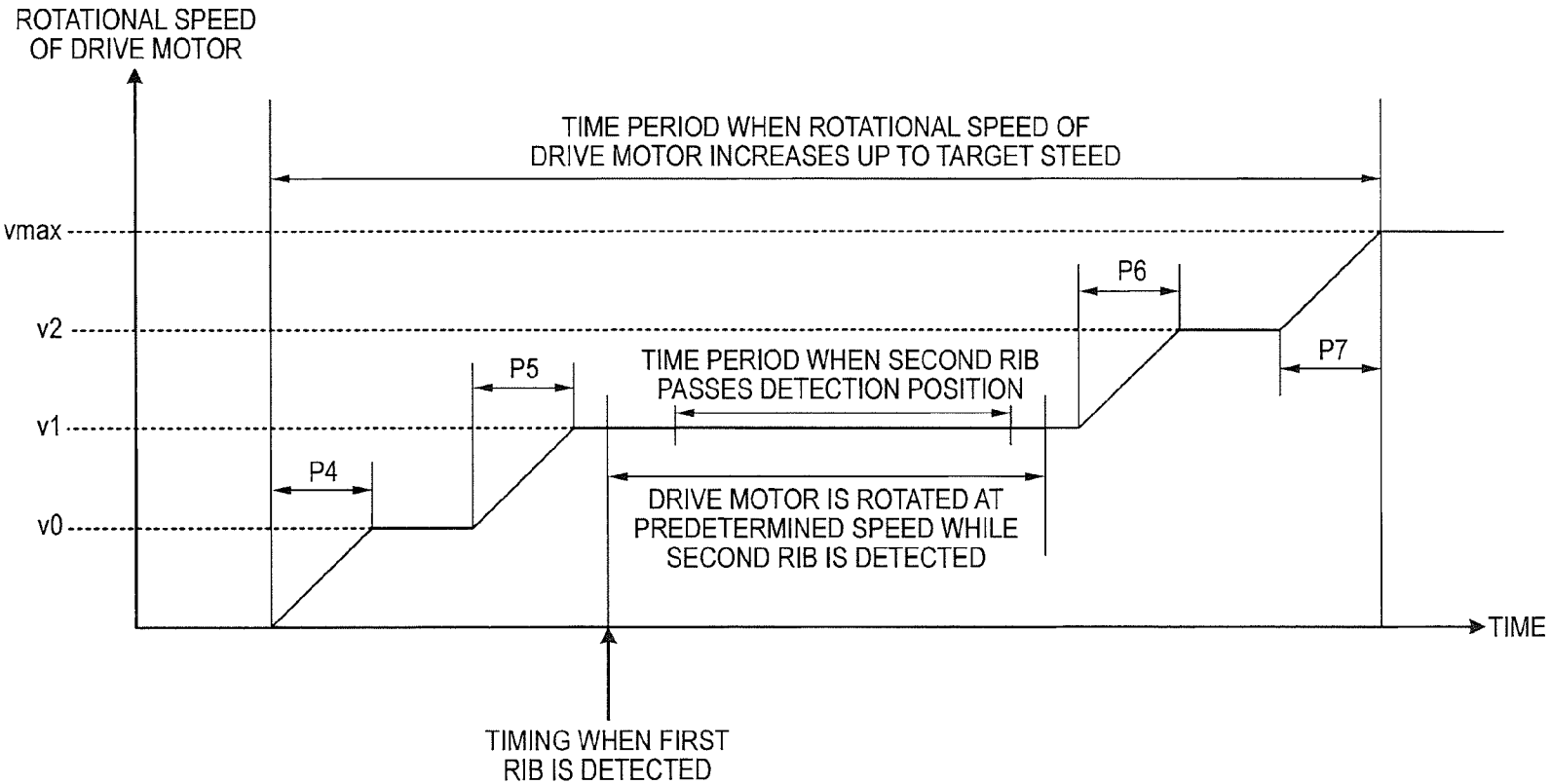
FIG. 10 is a graph illustrating control on a rotation of the drive motor in a case of a high load state.

FIG. 10 is a graph for explaining control on the rotation of the drive motor 75 in the case of the high load state. In the high load state where the load on the drive motor 75 is high, it is difficult to make an acceleration to accelerate (increase) the rotational speed of the drive motor 75 the same as the above-described first acceleration. Therefore, it takes more time for the rotational speed of the drive motor 75 to reach the target speed. In this case, if the time period when the second rib 67*b* passes the detection position is measured after the rotational speed of the drive motor 75 reaches the target speed, the timing to determine the kind of the toner cartridge or the remaining amount of toner is late. Further, before the rotational speed of the drive motor 75 reaches the target speed, the second rib 67*b* may pass the detection position.

Therefore, in the high load state where the load on the drive motor 75 is high, the control unit 70 measures the time period when the second rib 67*b* passes the detection position while the rotational speed of the drive motor 75 increases up to the target speed.

However, if the time period when the second rib 67*b* passes the detection position is measured while the rotational speed of the drive motor 75 increases, it is difficult to accurately determine the kind of the toner cartridge 60. Specifically, in a case where Ta has been measured as the time period when the second rib 67*b* passes the detection position while the drive motor 75 rotates at a predetermined speed v1, if the rotational speed of the drive motor 75 increases while the second rib 67*b* is detected, a time period (hereinafter, referred to as 'Tb') smaller than Ta is measured. Thus, if the measured time period is Ta, the measured time period almost coincides with the reference time period and thus it is possible to accurately determine the kind. However, in the case where the measured time period is Tb, the measured time period does not coincide with the reference time period and thus it is difficult to accurately determine the kind. This is similar in the determination of the remaining amount of toner. Therefore, if the rotational speed changes, it is difficult to accurately determine the remaining amount of toner.

For this reason, in the high load state where the load on the drive motor 75 is high, the control unit 70 rotates the drive motor 75 at a constant speed in the time period when the rotational speed of the drive motor 75 increases up to the target speed, and detects the detection targets such as the second rib 67*b* and the toner by the rib detecting unit 76 and the toner-remaining-amount detecting unit 77 in a state where the drive motor 75 rotates at the constant speed. After the detection finishes, the control unit 70 restarts to accelerate the drive motor 75.

Hereinafter, a case of detecting the second rib 67*b* by the rib detecting unit 76 will be described as an example in detail.

As described above, the first rib 67*a* has the role of notifying the control unit 70 that the second rib 67*b* will pass a detection position soon. Therefore, when the first rib 67*a* is detected, the control unit 70 rotates the drive motor 75 at the constant speed until the detection of the second rib 67*b* finishes. In the example shown in FIG. 10, there is shown a case where the first rib 67*a* is detected when the rotational speed of the drive motor 75 is v1. In the case where the first rib 67*a* is detected when the rotational speed of the drive motor 75 is v1, the control unit 70 rotates the drive motor 75 at the constant speed v1 until the detection of the second rib 67*b* finishes.

However, there are also cases where the first rib 67*a* is detected when the rotational speed of the drive motor 75 is v0 or v2. Specifically, the initial position of the first rib 67*a* may depend on the kind of the toner cartridge 60, and even if toner cartridges 60 are of the same kind, the initial positions of their first ribs 67*a* may be different from each other due to a tolerance in manufacturing. For example, in a case where the initial position of the first rib 67*a* is close to the detection position, when the rotational speed of the drive motor 75 is v0, the first rib 67*a* reaches the detection position, and in a case where the initial position of the first rib 67*a* is far from the detection position, when the rotational speed of the drive motor 75 is v2, the first rib 67*a* reaches the detection position.

Further, there may be a case where the first rib 67*a* reaches the detection position in a time period P5 when the drive motor 75 accelerates from v0 to v1, or there may be a case where the first rib 67*a* reaches the detection position in a time period P6 when the drive motor 75 accelerates from v1 to v2.

In a case where the first rib 67*a* is detected when the drive motor 75 rotates at a constant speed such as v0, v1, or v2, the control unit 70 rotates the drive motor 75 at the constant speed until the detection of the second rib 67*b* finishes.

On the other hand, in a case where the first rib 67*a* is detected in the time period P5 or P6 when the drive motor 75 accelerates, the control unit 70 accelerates the drive motor 75 to a predetermined speed and rotates the drive motor 75 at one of a plurality of constant speeds, which is faster than the rotational speed of the drive motor 75 during the detection of the first rib 67*a*, and is closest to the rotational speed of the drive motor 75 during the detection of the first rib 67*a*.

For example, in the case where the first rib 67*a* is detected in the time period P5, among the constant speeds v0, v1, and v2, the constant speeds v1 and v2 are faster than the rotational speed of the drive motor 75 during the detection of the first rib 67*a*. Further, of the constant speeds v1 and v2, the constant speed v1 is closest to the rotational speed of the drive motor 75 during the detection of the first rib 67*a*. Therefore, the control unit 70 continues to accelerate the drive motor 75 until the rotational speed reaches v1. When the rotational speed of the drive motor 75 reaches v1, the control unit 70 rotates the drive motor 75 at the constant speed v1 until the detection of the second rib 67*b* finishes.

In the time periods P4, P5, P6, and P7, accelerations to increase the rotational speed of the drive motor 75 are examples of the second acceleration.

Figure 11:
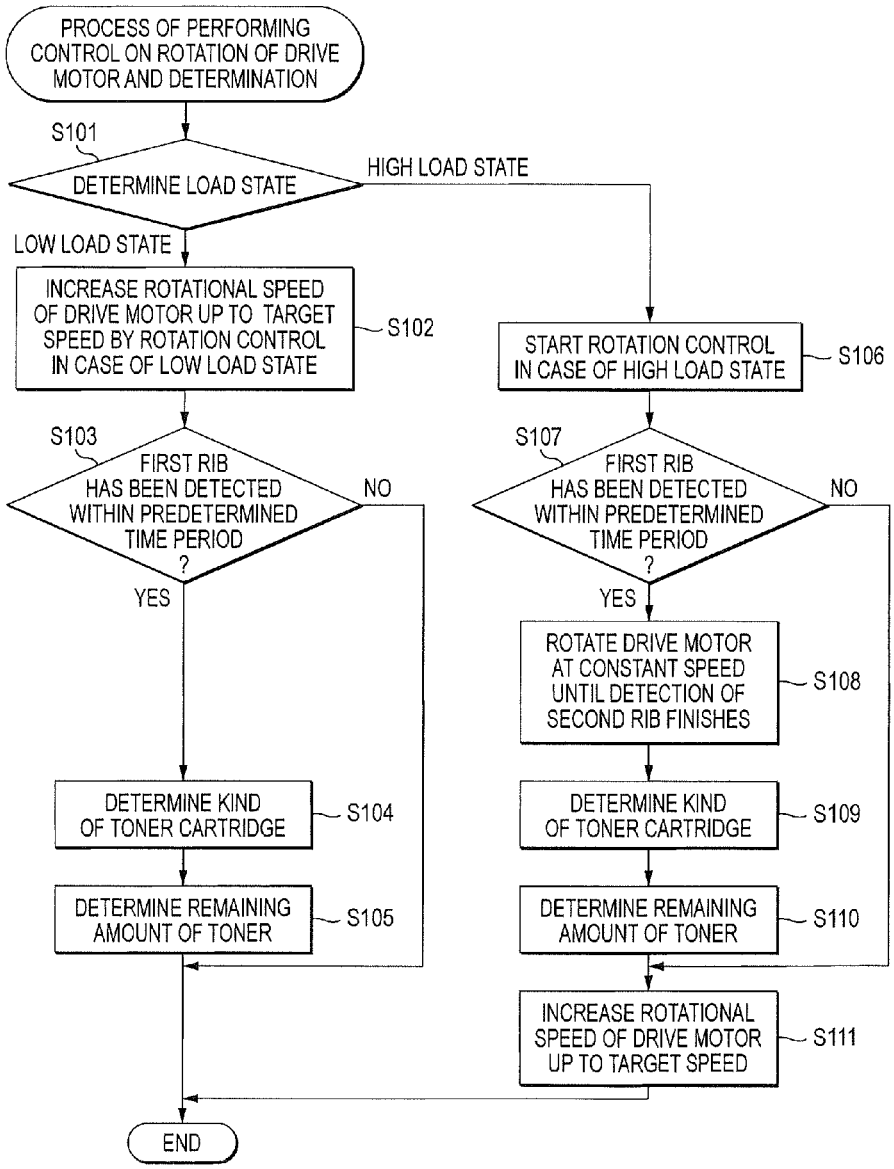
FIG. 11 is a flow chart illustrating a flow of a process of performing rotation control and determination.

(10-3) Flow of Process of Performing Control on Rotation of Drive Motor and Determination FIG. 11 is a flow chart illustrating a flow of a process of the control unit 70 to perform the control on the rotation of the drive motor 75 and the determination. Here, a case of determining whether the drive motor 75 is in the low load state or the high load state on the basis of the state of the film fixing unit 44 will be described as an example.

In STEP S101, the control unit 70 determines the load state of the drive motor 75. Specifically, the control unit 70 acquires a temperature signal from the temperature measuring sensor 44*c*. If the temperature represented by the acquired temperature signal is a predetermined temperature or more, the control unit 70 determines that the drive motor 75 is in the low load state, and proceeds to STEP S102. On the other hand, if the temperature represented by the acquired temperature signal is less than the predetermined temperature, the control unit 70 determines that the drive motor 75 is in the high load state, and proceeds to STEP S106. STEP S101 is one example of a load-state determining process.

In STEP S102, the control unit 70 accelerates the drive motor 75 up to the target speed by the rotation control in the case of the low load state shown in FIG. 9.

In STEP S103, the control unit 70 determines whether the first rib 67*a* has been detected within a predetermined time period after starting rotation of the drive motor 75. Specifically, the control unit 70 determines whether the rib detection signal has changed from the OFF state to the ON state. In a case where the rib detection signal has changed from the OFF state to the ON state, the control unit 70 determines that the first rib 67*a* has been detected. In the case where the first rib 67*a* has been detected, the control unit 70 determines that the toner cartridge 60 is new, and proceeds to STEP S104. In a case where the first rib 67*a* has not been detected, the control unit 70 determines that the toner cartridge 60 is the toner cartridge having been used, and finishes this process.

In STEP S104, the control unit 70 determines the kind of the toner cartridge 60 as described in '(7) Determination of Kind of Toner Cartridge'.

In the case of the low load state, after the rotational speed of the drive motor 75 reaches vmax (e.g., target speed), the kind of the toner cartridge 60 is determined. Therefore, the control unit 70 reads the reference time periods of all of the kinds of toner cartridges 60 corresponding to vmax, and determines that a kind associated with one of the read reference time periods closest to the measured time period is the kind of the currently installed toner cartridge 60.

In STEP S105, the control unit 70 determines the remaining amount of toner as described in '(9) Determination of Remaining Amount of Toner'.

In STEP S106, the control unit 70 starts rotation control to accelerate the drive motor 75 up to the target speed by the rotation control in the case of the high load state shown in FIG. 10.

In STEP S107, the control unit 70 determines whether the first rib 67*a* has been detected within a predetermined time period after starting rotation of the drive motor 75. In a case where the first rib 67*a* has been detected, the control unit 70 determines that the toner cartridge 60 is new, and proceeds to STEP S108. In a case where the rotational speed of the drive motor 75 has reached the target speed without the first rib 67*a* detected, the control unit 70 determines that the toner cartridge 60 is the toner cartridge having been used, and proceeds to STEP S111.

In STEP S108, the control unit 70 rotates the drive motor 75 at a constant speed until the detection of the second rib 67*b* finishes as described in '(10-2) Control on Rotation of Drive Motor in Case of High Load State'.

In STEP S109, the control unit 70 determines the kind of the toner cartridge 60 as described in '(7) Determination of Kind of Toner Cartridge'.

In the case of the high load state, the rotational speed of the drive motor 75 when the second rib 67*b* is detected is not fixed to one value. Therefore, the control unit 70 reads the reference time periods of all of the kinds of toner cartridges 60 corresponding to the rotational speed during the detection of the second rib 67*b*, and determines that a kind associated with one of the read reference time periods closest to the measured time period is the kind of the currently installed toner cartridge 60.

In STEP S110, the control unit 70 determines the remaining amount of toner as described in '(9) Determination of Remaining Amount of Toner'.

In STEP S111, the control unit 70 restarts to accelerate the drive motor 75, such that the rotational speed of the drive motor 75 increases up to the target speed.

The above-described STEPS S104, S105, S109, and S110 are examples of a determining process.

(11) Advantages

According to the printing apparatus 1 of the above-described exemplary embodiment, in a time period when the rotational speed of the drive motor 75 increases up to the target speed, the control unit 70 rotates the drive motor 75 at a constant speed, and detects the detection targets such as the second rib 67*b* and the toner detected by the rib detecting unit 76 and the toner-remaining-amount detecting unit 77 in a state where the drive motor 75 rotates at the constant speed. After this detection finishes, the control unit 70 restarts to accelerate the drive motor 75. Therefore, it is possible to perform the determination at an earlier timing as compared to the case of determining the kind of the toner cartridge 60 and the remaining amount of toner after the rotational speed of the drive motor 75 reaches a predetermined speed. Further, it is possible to more accurately perform the determination as compared to the case of determining the kind of the toner cartridge 60 and the remaining amount of toner while accelerating the drive motor 75.

Further, according to the printing apparatus 1, in the case where the drive motor 75 is in the high load state, the detection targets are detected in a time period when the rotational speed of the drive motor 75 increases up to the target speed. Therefore, even if the drive motor 75 is in the high load state, it is possible to determine the kind of the toner cartridge 60 and the remaining amount of toner at an early timing.

On the other hand, in the case where the drive motor 75 is in the low load state, after the rotational speed of the drive motor 75 reaches the target speed, the detection targets are detected. Therefore, it is possible to control the rotation of the drive motor 75 more simply as compared to the case of detecting the detection targets in the period when the drive motor 75 accelerates up to the target speed.

Furthermore, according to the printing apparatus 1, it is possible to determine the load state of the drive motor 75 by measuring the temperature correlating with the temperature of the lubricant G.

Moreover, according to the printing apparatus 1, the time period when the second rib 67*b* has been detected is compared to the reference time periods according to the rotational speed of the drive motor 75 during the detection of the second rib 67*b*. Therefore, even if the rotational speed of the drive motor 75 when the second rib 67*b* is detected is not fixed to one value, it is possible to determine the kind of the toner cartridge 60.

In addition, according to the printing apparatus 1, if the first rib 67*a* is detected while the drive motor 75 accelerates (e.g., in the time period P5 or P6), the drive motor 75 accelerates up to one of the plurality of constant speeds which is faster than the rotational speed of the drive motor 75 during the detection of the first rib 67*a* and is the closest to the rotational speed of the drive motor 75 during the detection of the first rib 67*a*, and rotates at the constant speed. Therefore, the number of constant speeds is fixed. When the number of constant speeds is fixed, it is possible to store the reference time periods according to the individual speeds in advance, and to reduce an amount of throughput as compared to a case of calculating a reference time period from the rotational speed of the drive motor 75.

Further, according to the printing apparatus 1, in the case where it is determined that the toner cartridge 60 is new, determination of the kind of the toner cartridge is performed. Since the toner cartridge 60 is new, it is possible to determine the kind of the toner cartridge 60.

Modifications to Exemplary Embodiments

Exemplary embodiments may not be limited to the exemplary embodiment explained by the above description and the drawings. For example, the following exemplary embodiments can be included in the technical scope.

(1) In the above-described exemplary embodiment, both of the kind of the toner cartridge 60 and the remaining amount of toner are determined. However, only any one of them may be determined.

In a case of determining only the remaining amount of toner, the determination can be performed any time regardless of whether the toner cartridge 60 is new or has been used. However, even in the case of determining the remaining amount of toner, if the determination is performed after the rotational speed of the drive motor 75 reaches the target speed, the determination timing may be late. Further, if the determination is performed while the rotational speed of the drive motor 75 increases, since the rotational speed of the drive motor 75 changes, it may be difficult to accurately determine the remaining amount of toner.

For this reason, in the time period when the rotational speed of the drive motor 75 accelerates up to the target speed, the control unit 70 rotates the drive motor 75 at a constant speed, and determines the remaining amount of toner. Therefore, the determination can be accurately performed at an early timing.

(2) In the above-described exemplary embodiment, the time periods when the rotational speed of the drive motor 75 accelerates and the time periods when the drive motor 75 rotates at the constant speeds are alternately repeated, such that the rotational speed increases up to the target speed in the stepwise manner. However, the rotational speed of the drive motor 75 may continuously increases up to the target speed. In this case, when the first rib 67*a* is detected, the control unit 70 may suspend the acceleration and rotate the drive motor 75 at a constant speed.

(3) In the above-described exemplary embodiment, the film fixing unit 44 has been described as an example of a fixing unit. However, the fixing unit is not limited to the film fixing unit 44. For example, it may be possible to use a fixing unit using a heating member formed by containing a halogen lamp in a roller.

(4) In the above-described exemplary embodiment, the case of determining the load state of the drive motor 75 from the temperature correlating with the temperature of the lubricant G has been described as an example. However, the method of determining the load state of the drive motor 75 is not limited thereto.

For example, when a predetermined time or more elapses after the heat source becomes the OFF state, the viscosity of the lubricant G increases such that the drive motor 75 becomes the high load state. Therefore, when the predetermined time or more elapses, it may be determined that the drive motor 75 is in the high load state, and before the predetermined time does not elapse, it may be determined that the drive motor 75 is in the low load state.

(5) In the above-described exemplary embodiment, a case where the first rib 67*a* and the second rib 67*b* move on a circular trajectory having the center at the rotation center of the sector gear 67 has been described. However, the first rib 67*a* and the second rib 67*b* may move on a linear trajectory.

(6) In the above-described exemplary embodiment, it is determined whether the state of the drive motor 75 is the low load state or the high load state. However, this determination may be skipped, and at any time of the time period when the rotational speed of the drive motor 75 increases up to the target speed, the control unit 70 may rotate the drive motor 75 at a constant speed and detect the detection targets.

(7) In the above-described exemplary embodiment, the case of determining the load state of the drive motor 75 from the load state of the film fixing unit 44 has been described as an example. However, the load state of the drive motor 75 may be determined from the load state of a rotary mechanism of the printing apparatus 1 other than the film fixing unit 44.

(8) In the above-described exemplary embodiment, the case where the first acceleration and the second acceleration are different from each other has been described as an example. However, even if the first acceleration and the second acceleration are the same, in the case where the load on the drive motor 75 is high, the acceleration of the drive motor 75 may finally become smaller than that in the case where the load is low. In this case, it is possible to set the first acceleration and the second acceleration to be the same as each other.

According to still another illustrative aspect of the invention, the cartridge is configured to accommodate toner for printing of the printing unit and comprises: a agitating member configured to rotate by the rotational driving force of the motor, so as to agitate the toner; and light transmitting windows that are provided at two facing walls of a toner container containing the toner. The detecting unit comprises: a light emitting unit configured to emit light from an outside of the cartridge toward one of the light transmitting windows; and a light receiving unit configured to receive the light having been emitted by the light emitting unit and having passed through the two light transmitting windows. The detection target is the toner and the agitating member. In the determining process, the control unit is configured to determine, as the state of the cartridge, a remaining amount of toner on the basis of the detection result of the detecting unit.

According to still another illustrative aspect of the invention, the image forming apparatus further comprises a rotary mechanism configured to rotate by the rotational driving force of the motor. The control unit is configured to perform a load-state determining process of determining whether the state of the rotary mechanism is a high load state where a load on the motor is a predetermined load or more or a low load state where the load on the motor is less than the predetermined load. In a case where it is determined that the state of the rotary mechanism is the low load state by the load-state determining process, in the rotation control process, the control unit is configured to: accelerate the rotational speed of the motor with a first acceleration; and detect the detection target by the detecting unit after the rotational speed of the motor reaches the target speed. In a case where it is determined that the state of the rotary mechanism is the high load state by the load-state determining process, in the rotation control process, the control unit is configured to: accelerate the rotational speed of the motor with a second acceleration that is smaller than the first acceleration; rotate the motor at a constant speed in the period when the rotational speed of the motor increases up to the target speed; and detect the detection target by the detecting unit.

According to still another illustrative aspect of the invention, the cartridge is configured to accommodate toner for printing of the printing unit. The rotary mechanism is a fixing unit, which comprises: a rotary body configured to rotate by the rotational driving force of the motor; a heat source configured to raise a temperature of the rotary body; and a lubricant for smoothly rotating the rotary body. In a case where it is determined that a predetermined time elapses after the heat source becomes an OFF state by the load-state determining process, the control unit is configured to determine that the state of the rotary mechanism is the high load state. In a case where it is determined that the predetermined time does not elapse after the heat source becomes the OFF state, the control unit is configured to determine that the state of the rotary mechanism is the low load state.

According to still another illustrative aspect of the invention, the cartridge is configured to accommodate toner for printing of the printing unit. The rotary mechanism is a film fixing unit, which comprises: a cylindrical film configured to rotate by the rotational driving force of the motor so as to thermally fix the toner onto the sheet; a heat source configured to raise a temperature of the film; and a lubricant for smoothly rotating the film. The image forming apparatus comprises a temperature measuring unit configured to measure a temperature of the film fixing unit. In the load-state determining process, the control unit is configured to measure the temperature of the film fixing unit by the temperature measuring unit, and in a case where the measured temperature is less than a predetermined temperature, the control unit is configured to determine that the state of the rotary mechanism is the high load state, and in a case where the measured temperature is the predetermined temperature or more, the control unit determines that the state of the rotary mechanism is the low load state.

According to still another illustrative aspect of the invention, in the determining process, the control unit is configured to compare the detection result of the detecting unit with reference values, which have been detected by the detecting unit after rotating the motor at the constant speed, according to the rotational speed, and to determine at least one of a kind of the cartridge and a state of the cartridge.

According to still another illustrative aspect of the invention, a plurality of constant speeds is set in a stepwise manner. In the rotation control process, in a case of rotating the motor at the constant speed, the control unit is configured to accelerate the motor up to one of the plurality of constant speeds, which is faster than the rotational speed of the motor during the detection of the detection target, and which is closest to the rotational speed of the motor during the detection of the detection target, and then to rotate the motor at the constant speed.

According to still another illustrative aspect of the invention, the detection target is configured to move on the movement trajectory in a case where the cartridge is new. The detection target is configured not to move on the movement trajectory in a case where the cartridge has been used. The image forming apparatus is configured to perform a newness determining process of determining whether the cartridge is new or has been used. In a case where it is determined that that the cartridge is new by the newness determining process, the control unit is configured to perform the rotation control process and the determining process.

According to still another illustrative aspect of the invention, the control unit is configured to switch the mode for controlling the motor from the constant mode to the accelerating mode when the detection result of the detecting unit changes from detecting the detection target to not detecting the detection target.

According to still another illustrative aspect of the invention, the detection target comprises a first detection target and a second detection target. The control unit is configured to: switch the mode for controlling the motor from the accelerating mode to the constant mode when the detecting unit detects the first detection target; maintain the rotation speed of the motor at the constant speed while the detecting unit detects the second detection target; and switch the mode for controlling the motor from the constant mode to the accelerating mode when the detection result of the detecting unit changes from detecting the second detection target to not detecting the second detection target.

According to still another illustrative aspect of the invention, the cartridge comprises a gear rotatably supported by a shaft. The detection target is disposed on the gear and is configured to rotate with the gear.

According to still another illustrative aspect of the invention, the detection target is a rib. The detecting unit is configured to detect the rib.

According to still another illustrative aspect of the invention, the image forming apparatus further comprises a fixing unit configured to fix an image on a sheet. The motor is configured to drive both the cartridge and the fixing unit.

According to still another illustrative aspect of the invention, the fixing unit comprises: a film; a plate configured to be slidably in contact with the film; a pressing roller configured to press the film toward the plate; and a heater configured to heat the film. A lubricant is applied between the plate and the film.

What is claimed is:

1. An image forming apparatus comprising:

a motor;

a mounting unit configured to receive a cartridge mounted therein, the cartridge having a detection target configured to be moved by a rotational driving force of the motor;

a printing unit configured to print an image on a sheet using the cartridge;

a detecting unit configured to detect the detection target at a detection position on a movement trajectory of the detection target; and a control unit configured to control the motor and the detecting unit, wherein the control unit is configured to perform:

a rotation control process of:

accelerating a rotational speed of the motor;

rotating the motor at a constant speed in a time period when accelerating the rotational speed of the motor up to a target speed;

detecting the detection target by the detecting unit in the state where the motor rotates at the constant speed; and accelerating again the rotational speed of the motor after completing the detection; and a determining process of determining at least one of a kind of the cartridge and a state of the cartridge on the basis of the detection result of the detecting unit.

2. The image forming apparatus according to claim 1, wherein the cartridge is configured to accommodate toner for printing of the printing unit and comprises:

a agitating member configured to rotate by the rotational driving force of the motor, so as to agitate the toner; and light transmitting windows that are provided at two facing walls of a toner container containing the toner, wherein the detecting unit comprises:

a light emitting unit configured to emit light from an outside of the cartridge toward one of the light transmitting windows; and a light receiving unit configured to receive the light having been emitted by the light emitting unit and having passed through the two light transmitting windows, wherein the detection target is the toner and the agitating member, and wherein in the determining process, the control unit is configured to determine, as the state of the cartridge, a remaining amount of toner on the basis of the detection result of the detecting unit.

3. The image forming apparatus according to claim 1, further comprising:

a rotary mechanism configured to rotate by the rotational driving force of the motor, wherein the control unit is configured to perform a load-state determining process of determining whether the state of the rotary mechanism is a high load state where a load on the motor is a predetermined load or more or a low load state where the load on the motor is less than the predetermined load, in a case where it is determined that the state of the rotary mechanism is the low load state by the load-state determining process, in the rotation control process, the control unit is configured to:

accelerate the rotational speed of the motor with a first acceleration; and detect the detection target by the detecting unit after the rotational speed of the motor reaches the target speed, and in a case where it is determined that the state of the rotary mechanism is the high load state by the load-state determining process, in the rotation control process, the control unit is configured to:

accelerate the rotational speed of the motor with a second acceleration that is smaller than the first acceleration;

rotate the motor at a constant speed in the period when the rotational speed of the motor increases up to the target speed; and detect the detection target by the detecting unit.

4. The image forming apparatus according to claim 3, wherein the cartridge is configured to accommodate toner for printing of the printing unit, wherein the rotary mechanism is a fixing unit, which comprises:

a rotary body configured to rotate by the rotational driving force of the motor;

a heat source configured to raise a temperature of the rotary body; and a lubricant for smoothly rotating the rotary body, wherein in a case where it is determined that a predetermined time elapses after the heat source becomes an OFF state by the load-state determining process, the control unit is configured to determine that the state of the rotary mechanism is the high load state, and wherein in a case where it is determined that the predetermined time does not elapse after the heat source becomes the OFF state, the control unit is configured to determine that the state of the rotary mechanism is the low load state.

5. The image forming apparatus according to claim 3, wherein the cartridge is configured to accommodate toner for printing of the printing unit, wherein the rotary mechanism is a film fixing unit, which comprises:

a cylindrical film configured to rotate by the rotational driving force of the motor so as to thermally fix the toner onto the sheet;

a heat source configured to raise a temperature of the film; and a lubricant for smoothly rotating the film, wherein the image forming apparatus comprises a temperature measuring unit configured to measure a temperature of the film fixing unit, and wherein in the load-state determining process, the control unit is configured to measure the temperature of the film fixing unit by the temperature measuring unit, and in a case where the measured temperature is less than a predetermined temperature, the control unit is configured to determine that the state of the rotary mechanism is the high load state, and in a case where the measured temperature is the predetermined temperature or more, the control unit determines that the state of the rotary mechanism is the low load state.

6. The image forming apparatus according to claim 1, wherein in the determining process, the control unit is configured to compare the detection result of the detecting unit with reference values, which have been detected by the detecting unit after rotating the motor at the constant speed, according to the rotational speed, and to determine at least one of a kind of the cartridge and a state of the cartridge.

7. The image forming apparatus according to claim 6, wherein a plurality of constant speeds is set in a stepwise manner, and wherein in the rotation control process, in a case of rotating the motor at the constant speed, the control unit is configured to accelerate the motor up to one of the plurality of constant speeds, which is faster than the rotational speed of the motor during the detection of the detection target, and which is closest to the rotational speed of the motor during the detection of the detection target, and then to rotate the motor at the constant speed.

8. The image forming apparatus according to claim 1, wherein the detection target is configured to move on the movement trajectory in a case where the cartridge is new, wherein the detection target is configured not to move on the movement trajectory in a case where the cartridge has been used, wherein the image forming apparatus is configured to perform a newness determining process of determining whether the cartridge is new or has been used, and wherein in a case where it is determined that that the cartridge is new by the newness determining process, the control unit is configured to perform the rotation control process and the determining process.

9. An image forming apparatus comprising:

a motor;

a cartridge having a detection target configured to be moved by a driving force of the motor;

a detecting unit configured to detect the detection target; and a control unit configured to:

control the motor in an accelerating mode in which the control unit accelerates a rotation speed of the motor up to a target speed; and control the motor in a constant mode in which the control unit maintains the rotation speed of the motor at a constant speed, wherein the control unit is configured to switch a mode for controlling the motor from the accelerating mode to the constant mode when the detecting unit detects the detection target, and wherein the control unit is configured to determine a state of the cartridge on the basis of the detection result of the detecting unit after the control unit switches the mode for controlling the motor from the accelerating mode to the constant mode.

10. The image forming apparatus according to claim 9, wherein the control unit is configured to switch the mode for controlling the motor from the constant mode to the accelerating mode when the detection result of the detecting unit changes from detecting the detection target to not detecting the detection target.

11. The image forming apparatus according to claim 9, wherein the detection target comprises a first detection target and a second detection target, and wherein the control unit is configured to:

switch the mode for controlling the motor from the accelerating mode to the constant mode when the detecting unit detects the first detection target;

maintain the rotation speed of the motor at the constant speed while the detecting unit detects the second detection target; and switch the mode for controlling the motor from the constant mode to the accelerating mode when the detection result of the detecting unit changes from detecting the second detection target to not detecting the second detection target.

12. The image forming apparatus according to claim 9, wherein the cartridge comprises a gear rotatably supported by a shaft, and wherein the detection target is disposed on the gear and is configured to rotate with the gear.

13. The image forming apparatus according to claim 9, wherein the detection target is a rib, and wherein the detecting unit is configured to detect the rib.

14. The image forming apparatus according to claim 9, further comprising:

a fixing unit configured to fix an image on a sheet, wherein the motor is configured to drive both the cartridge and the fixing unit.

15. The image forming apparatus according to claim 14, wherein the fixing unit comprises:

a film;

a plate configured to be slidably in contact with the film;

a pressing roller configured to press the film toward the plate; and a heater configured to heat the film, and wherein a lubricant is applied between the plate and the film.

* * * * *